US005133590A

United States Patent [19]

Fitjer

[11] Patent Number: 5,133,590

[45] Date of Patent: Jul. 28, 1992

[54] METHOD OF MAKING A MASCARA BRUSH

[75] Inventor: Holger Fitjer, Ansbach, Fed. Rep. of Germany

[73] Assignee: Georg Karl Geka-Brush GmbH, Bechhofen-Waizendorf, Fed. Rep. of Germany

[21] Appl. No.: 832,644

[22] Filed: Feb. 10, 1992

Related U.S. Application Data

[62] Division of Ser. No. 471,312, Jan. 29, 1990.

[51] Int. Cl.[5] ..... A46B 3/18; A46B 3/02

[52] U.S. Cl. ..... 300/21; 15/206; 15/160

[58] Field of Search ..... 15/206, 192, 159 A, 15/160, 210 R, 146, 167.1, 186; 300/21; 401/118

[56] References Cited

U.S. PATENT DOCUMENTS

| | | | |
|---|---|---|---|
| 1,034,576 | 8/1912 | Braun | 15/206 |
| 2,317,485 | 4/1943 | Rider | 15/159 A |
| 2,763,104 | 9/1956 | Lindenborg | 15/159 A |
| 2,887,340 | 5/1959 | Veneko | 15/159 R |
| 3,050,070 | 8/1962 | Sidelman | 15/159 A |
| 3,086,820 | 4/1963 | Baumgartner | 300/21 |
| 3,124,823 | 3/1964 | Charvat | 300/21 |
| 3,153,800 | 10/1964 | Trotin | 15/159 A |
| 3,556,667 | 1/1971 | Kaufman | 15/159 A |
| 3,771,189 | 11/1973 | Horton et al. | 15/159 A |
| 3,949,765 | 4/1976 | Vallis | 15/159 A |
| 4,133,147 | 1/1979 | Swift, Jr. | 15/159 A |
| 4,587,148 | 5/1986 | Campbell | 428/88 |
| 4,733,425 | 3/1988 | Hartel et al. | 15/159 A |
| 4,828,420 | 5/1989 | Otsuka et al. | 15/159 A |
| 4,861,179 | 8/1989 | Schrepf et al. | 15/159 A |
| 4,889,228 | 12/1989 | Gueret | 401/118 |
| 4,927,281 | 5/1990 | Gueret | 15/159 A |

*Primary Examiner*—Harvey C. Hornsby
*Assistant Examiner*—Gary Graham
*Attorney, Agent, or Firm*—Browdy and Neimark

[57] ABSTRACT

The invention relates to a mascara brush with bristles bound by twisting in a twin-layer wire core, the bristles consisting of multiple fibres bound by means of a binding agent which can be dissolved out.

Furthermore, the invention relates to a method of manufacture of a mascara brush, the bound multiple layer bristles being bound by twisting into the wire core and subsequently, as a result of the dissolving out of the binding agent with a solvent, being split apart into the individual fibres.

3 Claims, 1 Drawing Sheet

METHOD OF MAKING A MASCARA BRUSH

This application is a division of application Ser. No. 07/471,312, filed Jan. 29, 1990.

FIELD OF THE INVENTION

The invention relates to a mascara brush with bristles bound by twisting in a thin-layer wire core.

BACKGROUND OF THE INVENTION

The majority of mascara brushes available on the market are of the construction described above, according to which a flat layer of bristles between two wires—generally, in this arrangement, there is a single bent back wire—are bound into a spiral brush by the twisting of the wires. This construction is extremely rational and advantageous in price.

These known masacara brushes, however, with twisted wire core have this drawback that the bristles do not constitute a closed dense surface but, as already stated, are arranged substantially along a spiral helical surface. Therebetween there occur gaps of varying width which are dependent upon the bristle diameter and particularly also upon the coil turn distance of the twisted wire core. If these gaps are too great, which is always the case in terms of the distance, for example, from the eyelashes, the danger occurs that several hairs from the eyelashes will enter such a gap, and then on the application of the mascara will stick together. This, of course, must be avoided at all costs.

SUMMARY OF THE INVENTION

It is therefore the object of the invention to provide a mascara brush of the type first defined hereinabove in such a manner that with a simple method of construction the bristle ends fill up a dense closed surface.

For the achievement of this object it is provided in conformity with the invention that the bristles consist of multiple bristles bound by a releasable binding agent.

As a result of the utilisation according to the invention of bound multiple fibres as bristles the bristles can have the normal easy-to-process thickness, such as found also in the mascara brushes known hitherto. It is not till the bristles have been twisted in and the binding in of these bristles has been effected thereby that they are released as individual multiple fibres, while by dipping into a corresponding binding agent solvent the binding agent is released away, so that the individual thin bristles become free. They then correspondingly spring up, thereby filling the initially existing gaps between the coil turn surfaces more densely taken up by fibres. The danger of the sticking of hairs of the eyelashes jointly entering the gaps is thereby avoided.

As opposed to corresponding fine fibres which are then seen as the end effect the use of the bound multiple fibres is advantageous for several reasons. Firstly, these thin fine fibres which are thus obtained as a final effect, are not bound in in the same simple manner into the wire core by twisting. Secondly, in the end, the same difficulty would then occur on twisting, i.e. that the very thin fibres, even though in a greater number, are again in the first place concentrated on the coil turn surfaces. It is not till the splitting apart after twisting in that the springing up leads to the closure of the gaps still remaining at the outset between the turns of the coil.

Further advantages, characteristics and individual parts of the invention will be found in the following description of an example of embodiment as well as in a consultation of the drawings.

DESCRIPTION OF THE PREFERRED EMBODIMENT

Figure 1:
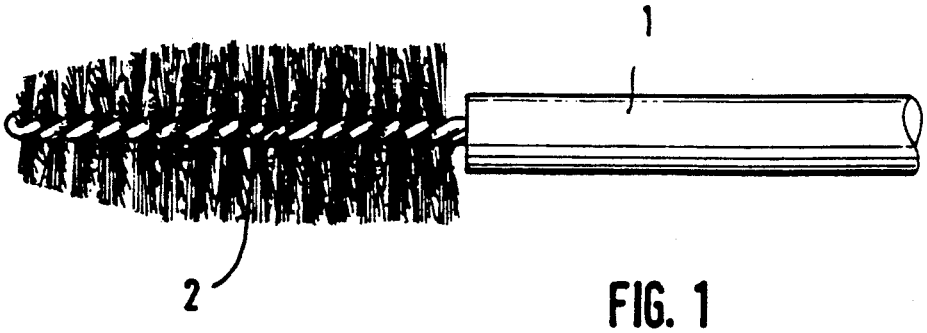
FIG. 1 is a side view of a mascara brush of the invention with fanned out multiple fibres.
Figure 2:
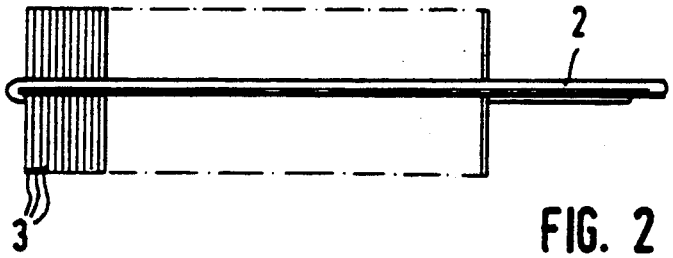
FIG. 2 is a diagrammatic view intended to clarify the binding in of the multiple fibres before the actual twisting.

FIG. 1 shows a mascara brush with a handle 1 of the usual type and a two-layer wire core 2 secured onto it which is formed (cf. FIG. 2) of a bent back single wire.

Figure 3:
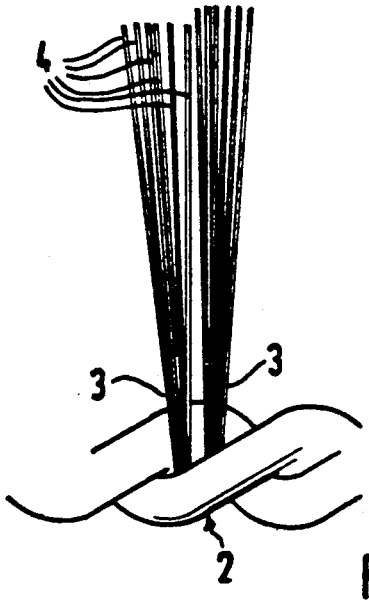
FIG. 3 is a magnified partial view of the mascara brush to make the fanning out of the multiple fibres clearer.
Figure 4:
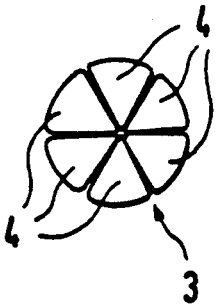
FIG. 4 is a cross-section through a bound multiple fibre.

In this wire core 2 the bristles 3 initially laid as a flat cluster between the bent back wire ends are bound in by twisting, as a result of which the usual pattern of mascara brushes is obtained, the bristles being distributed in substantially flat fashion on spiral surfaces produced by the rise of the twisting of the wire core 2. There arise as a result correspondingly wide gaps between these coil planes more densely occupied by the fibres 3, with the drawbacks first defined in detail hereinabove. According to the invention the bristles 3 consist of multiple fibres as shown in cross-section in FIG. 4, these multiple fibres being, as a plurality of individual fibres 4, joined by a releasable binding agent to form a multiple fibre bristle. Naturally, in this arrangement, the special sector-shaped cross-section of the individual fibres 4 must not be provided, although this is surely of advantage in the construction. It is decisive that one should have at the outset, for the binding in of the bristles 3, correspondingly thick fibres which are not split up into the individual fibres 4 after binding in till the brush has been dipped into a solvent which dissolves the binding agent out. This subsequent splitting apart is also decisive because, thereby, as will be seen in FIG. 3, the individual fibres 4 of a bristle produce a conical spreading apart, so that, in conformity with the final pattern shown in FIG. 1, the individual fibres fill out the gaps between the levels of the turns to a varying degree, and in any event to such an extent that a sticking of eyelashes having entered between such spiral or turn levels is avoided.

I claim:

1. A method of manufacture of a mascara brush with bristles bound by twisting in a twin-layer wire core, wherein the bristles (3) consist of multiple fibres (4) bound together by means of a binding agent which can be dissolved out, said method being characterized in that the bound multiple layer bristles (3) are bound by twisting into the wire core (2) and are subsequently, as a result of the dissolving out of the binding agent with a solvent, split apart into the individual fibres (4).

2. A method of forming a mascara brush with bristles bound by twisting in a twin-layer wire core with each bristle being formed by a plurality of individual fibers conically spreading apart from a point between said wires, comprising bonding together a plurality of individual fibers with a soluble binding agent to provide a plurality of bristles, each bristle comprising a bundle of adhered fibers, forming a mascara brush with said bristles bound by twisting said bristles in a twin-layer wire core to provide a generally helical pattern of said bristles extending from between said pair of wires, and dissolving said soluble binding agent whereby said individual fibers of each bristle are held together only at a base point between said twisted wires such that said fibers spread apart from said base point in the form of a conical configuration for each said bristle.

3. A method according to claim 2, wherein said fibers are sector-shaped in cross-section thereby providing sector-shapes such that said sector-shapes together form an essentially round bristle.

* * * * *